US005301487A

United States Patent [19]

Wiebe

[11] Patent Number: 5,301,487

[45] Date of Patent: Apr. 12, 1994

[54] WOODEN STRUCTURAL MEMBER FOR USE IN A BUILDING

[76] Inventor: Jacob R. Wiebe, 60 Heaton Avenue, Winnipeg, Manitoba, Canada, R3B 3E3

[21] Appl. No.: 924,872

[22] Filed: Aug. 5, 1992

Related U.S. Application Data

[63] Continuation-in-part of Ser. No. 677,432, Mar. 29, 1991, abandoned.

[51] Int. Cl.[5] ..... E04C 3/26; E04C 3/292; E04B 2/70

[52] U.S. Cl. ..... 52/743; 52/745.19

[58] Field of Search ..... 52/407, 408, 690, 693, 52/368, 372, 374, 376, 274, 743, 745.19

[56] References Cited

U.S. PATENT DOCUMENTS

| | | | |
|---|---|---|---|
| 316,895 | 4/1885 | Hubbard | 52/408 |
| 959,946 | 5/1910 | Knode | 52/368 |
| 1,036,049 | 8/1912 | Wunder | 52/369 |
| 1,089,878 | 3/1914 | Steinhauser | 52/369 |
| 1,218,385 | 3/1917 | Fellgren | 52/370 |
| 1,237,344 | 8/1917 | Klein | 411/460 |
| 1,475,409 | 11/1923 | Riddle | 52/374 |
| 1,532,954 | 4/1925 | Rumpler | 52/274 |
| 1,588,655 | 6/1926 | Brunnel | 52/274 |
| 1,710,891 | 4/1929 | O'Hare | 52/369 |
| 1,946,560 | 2/1934 | Wick | 52/376 |
| 2,085,472 | 6/1937 | Roush | 52/376 |
| 2,222,037 | 11/1940 | Lafferty | 52/221 |
| 2,326,717 | 8/1943 | Zeidler | 52/407 |
| 3,438,161 | 4/1969 | Koch | 411/460 |
| 3,736,718 | 6/1973 | Sylvan | 52/DIG. 66 |
| 4,207,719 | 6/1980 | Knowles | 52/694 |
| 4,617,776 | 10/1986 | Bergstrom | 52/690 |
| 4,819,400 | 4/1989 | Kindberg | 52/693 |
| 4,862,667 | 9/1989 | Melland | 52/729 |

FOREIGN PATENT DOCUMENTS

| | | | |
|---|---|---|---|
| 820068 | 11/1951 | Fed. Rep. of Germany | 52/368 |

*Primary Examiner*—James L. Ridgill, Jr.

*Attorney, Agent, or Firm*—Adrian D. Battison; Stanley G. Ade; Murray E. Thrift

[57] ABSTRACT

A wooden structural member for use as a stud in the wall of a building is formed from two strips of wood separated simply by elongate pins at right angles to the length of the strips. Each pin has pointed ends which are punctured into the wood of the strips to provide a frictional engagement therewith. After formation of the structural element, it is formed into the wall of a building and services can be threaded through the space between the strips following which insulation material is applied between each stud and the next and in between the strips thus increasing the insulation value of the wall, reducing the amount of lumber required and simplifying construction.

9 Claims, 5 Drawing Sheets

WOODEN STRUCTURAL MEMBER FOR USE IN A BUILDING

This application is a continuation-in-part of application Ser. No. 677,432, filed Mar. 29, 1991 and now abandoned.

BACKGROUND OF THE INVENTION

This invention relates to a method of forming the building using the wooden structural member.

Many buildings are formed from wooden frames which is then coated or covered on the inside and outside surfaces with suitable sheathing material. The wood frame buildings include a floor plate, a plurality of vertical wall studs arranged at horizontally spaced positions to thus form a vertical wall and a top plate for the wall. In most cases a roof structure is applied which also includes ceiling joists and roof trusses.

In most cases the joists and studs are formed from solid lumber and in imperial measure these structural members are nominally formed as two inches by four inches or two inches by six inches et cetera. In practice of course after planing these sizes are reduced so that a nominal 2×4 has a conventional dimension of the order of 1.5 inches by 3.5 inches.

For many years wooden frame buildings of this type used wall studs which are simply 2×4 and joists which are suitably dimensioned depending upon the intended size of the building. However solid lumber of this type has a number of disadvantages.

Firstly solid lumber is a relatively poor insulating material so that there is significant communication of heat from the inside edge of the lumber adjacent the warm interior outwardly to the outside surface of the lumber which is adjacent the cold exterior.

Secondly the solid lumber divides the wall into separated compartments so that there is no possibility of communication from one compartment to the next and therefore it is necessary to cut or drill holes in the studs for transmission of services to the building such as the electrical wiring.

Thirdly it is becoming more difficult to provide single pieces of lumber in the wider widths now required over a full length of the lumber in view of logging practices. The reduced availability therefore of the full size of the lumber in the length and width directions provides a significant increase in cost relative to the basic volume of wood required for the structural member. Thus solid wood structural member of for example 2×12 is significantly more expensive than two pieces of 2×6.

The formation of trusses using two strips of lumber is of course well known. Examples of these devices are shown in U.S. Pat. Nos. 4,372,093 (Ericsson); 4,741,139 (Campbell); 4,485,606 (Gottlieb); 4,541,218 (Gottlieb); 4,669,243 (Gore et al); 4,827,688 (Tene). However trusses of this type can be relatively expensive in view of the expense of the hardware involved. In addition the hardware provides a significant quantity of metal for communication of heat through the structural member. Trusses of this type have therefore achieved little success in the construction field. Trusses used as floor joists involving an upper strip and a lower strip which are connected by plywood which is rebated into a slot within the upper and lower strips has become more widely used but is solely used as floor joists and is particularly used for the greater accuracy and structural rigidity which is obtained which reduces movement, flexing and noise from the floor structure. Problems of this type however are of limited value in the formation of walls.

SUMMARY OF THE INVENTION

It is one object of the present invention, therefore, to provide an improved structural member for use in a building construction and an improved method of forming a building using the structural member.

According to the invention therefore, there is provided a method of forming a building comprising providing a plurality of structural members each comprising a wooden structural member for use in a building construction comprising a first and a second elongate strip of wood arranged in spaced mutually parallel relationship and a plurality of connecting members extending from one surface of the first strip to one surface of the second strip so as to hold the strips in said relationship with said one surfaces of the first and second strips spaced apart to define a space therebetween, each said connecting member comprising a separate elongate metal member projecting from the interior of the first strip through said one surface thereof, across the space, through said one surface of the second strip and into the interior of the second strip, locating the structural members in vertical orientation and in horizontally spaced location to define a frame of a wall of the building such that one strip of each structural member faces inwardly of the building and one strip faces outwardly of the building.

Preferably the connecting members are simple straight elongate pins with each end pointed so that each end is driven into the wooden strip from the inwardly facing surface of the strip and terminates within the interior of the strip. The hardware providing the coupling between the strips is therefore very inexpensive and can be applied very quickly and cheaply at low cost.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 3:
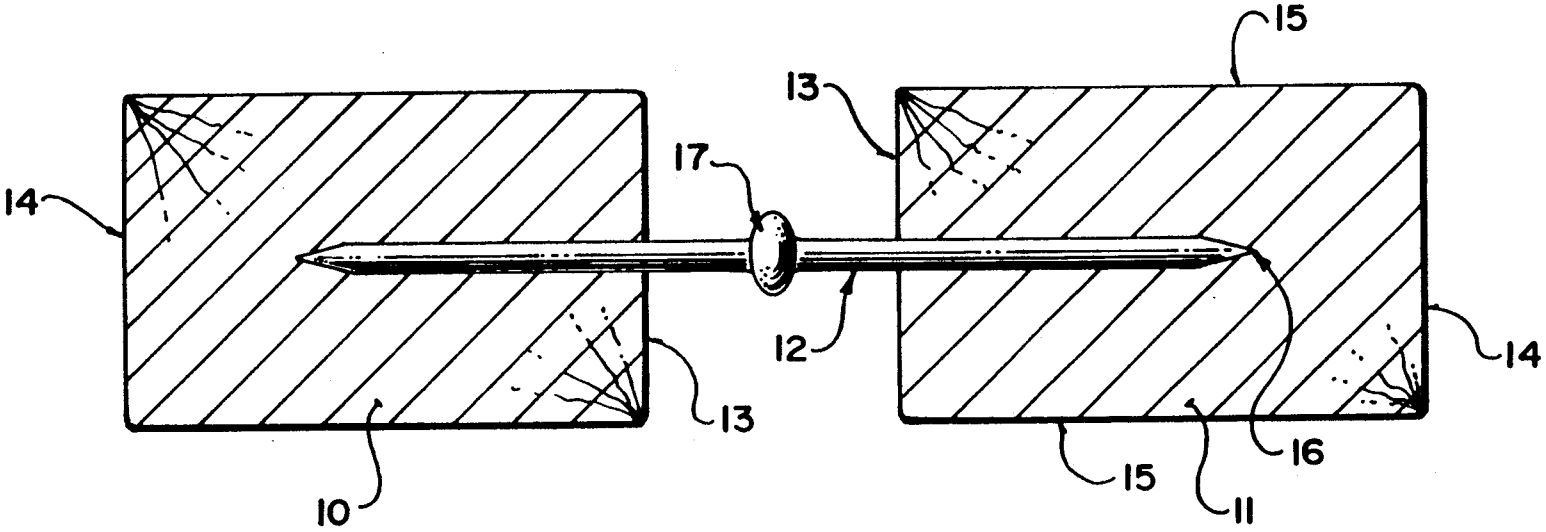
FIG. 3 is a cross-sectional view through one structural member according to the present invention.

Turning firstly to FIG. 3 there is shown a structural member in cross-section which includes a first strip 10 of solid wood and a second strip 11 also of solid wood. The strips are connected together by a connecting member 12. Each of the strips of wood is rectangular in cross-section defining an inwardly facing surface 13, an outwardly facing surface 14 and two side surfaces 15.

The connecting member comprises a simple elongate pin or rod formed from metal with each end of the pin being sharpened to form a point 16. At a central position of the pin is provided a lug 17 which projects outwardly to the side of the pin or more preferably surrounds the pin as an annular projection. The length of the pin is selected so that it extends from the interior of the strip 10 through the inwardly facing surface 13 to the space between the two strips and then through the surface 13 into the interior of the strip 11.

Figure 1:
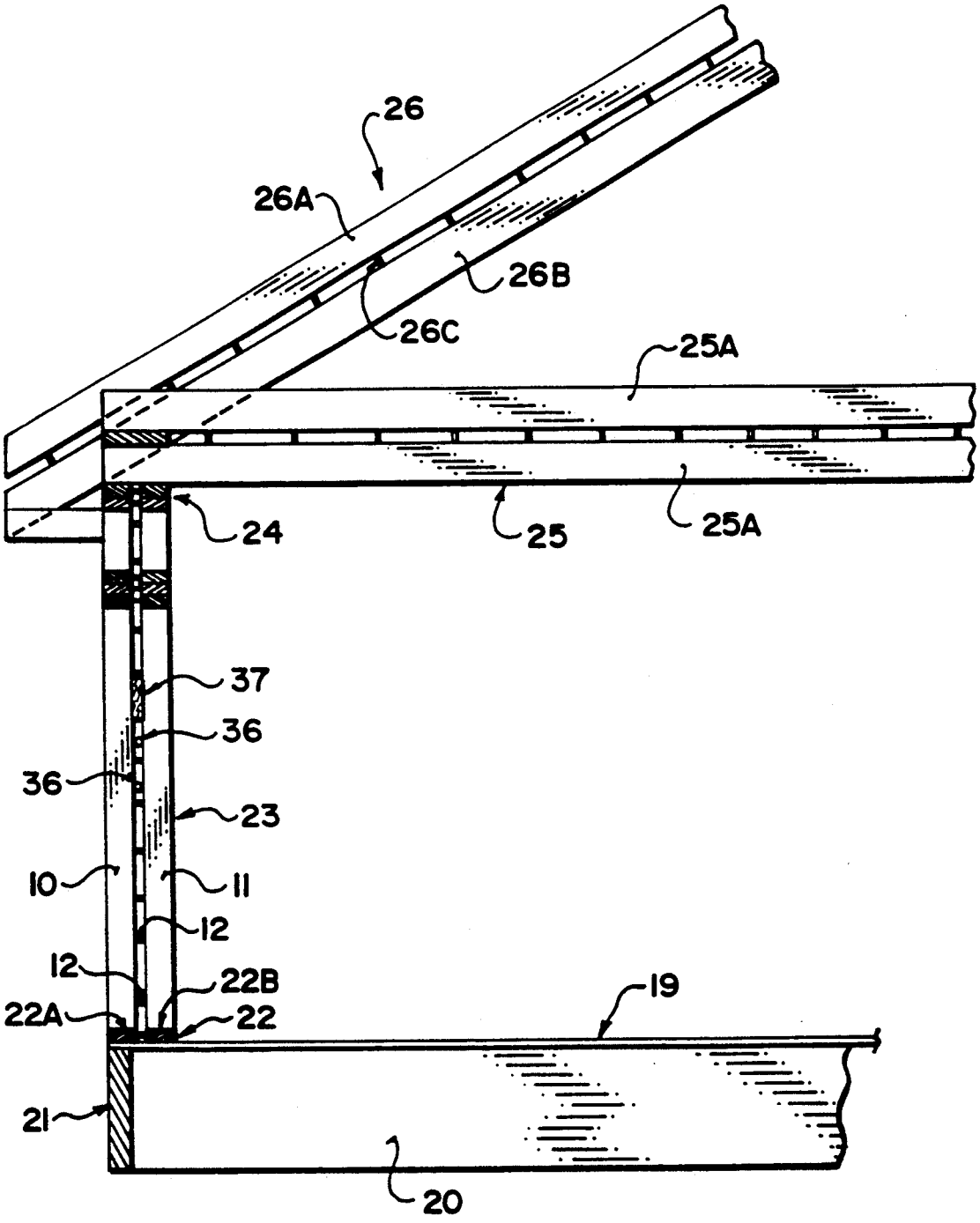
FIG. 1 is a schematic cross-sectional view through a building showing the structure of the walls, ceiling joists and roof trusses.

As shown in FIG. 1 the wall structure of the building is defined by a plurality of such structural members including the strip 10 and the strip 11 in parallel spaced location held apart by the pins 12. Thus the pins are at spaced locations along the length of the strips 10 and 11.

The building further includes a floor 19 mounted on floor joists 20 and a facing plate 21 at the edge of the floor joists. A floor plate 22 is formed from a structural member of the type described above including two parallel strips and the connecting pins. The floor plate lies parallel to the wall indicated at 23 so that the lower most edges of the strips 10 and 11 lie upon strips 22A and 22B of the floor plate.

Similarly a header is indicated at 24 and is in this case formed from two such structural members each lying in a horizontal plane so that the strips lie on top of one another and on top of the upper edges of the wall 23. The length of the strips 10 and 11 of the wall are therefore coextensive so as to lie on the upper of the floor plate 22 and to define a horizontal receiving surface for the lower surface of the header 24.

The ceiling joists indicated at 25 of the building are similarly formed from similar structural members so that the structural members lie in a vertical plane with the pins extending vertically downwardly and connecting an upper strip 25A to a lower strip 25B.

The roof trusses are similarly formed as indicated at 26 including an upper strip 26A, a lower strip 26B and pins 26C.

The construction of the building uses conventional techniques so that the ceiling joists 25 sit on the header 24 and the roof trusses 26 also lie on the header 24 and are nailed to the ceiling joist 25 which lie alongside the roof trusses. The use of the structural member for the roof truss can avoid the necessity for cross-truss members which are conventionally used in roof truss structures.

Figure 4:
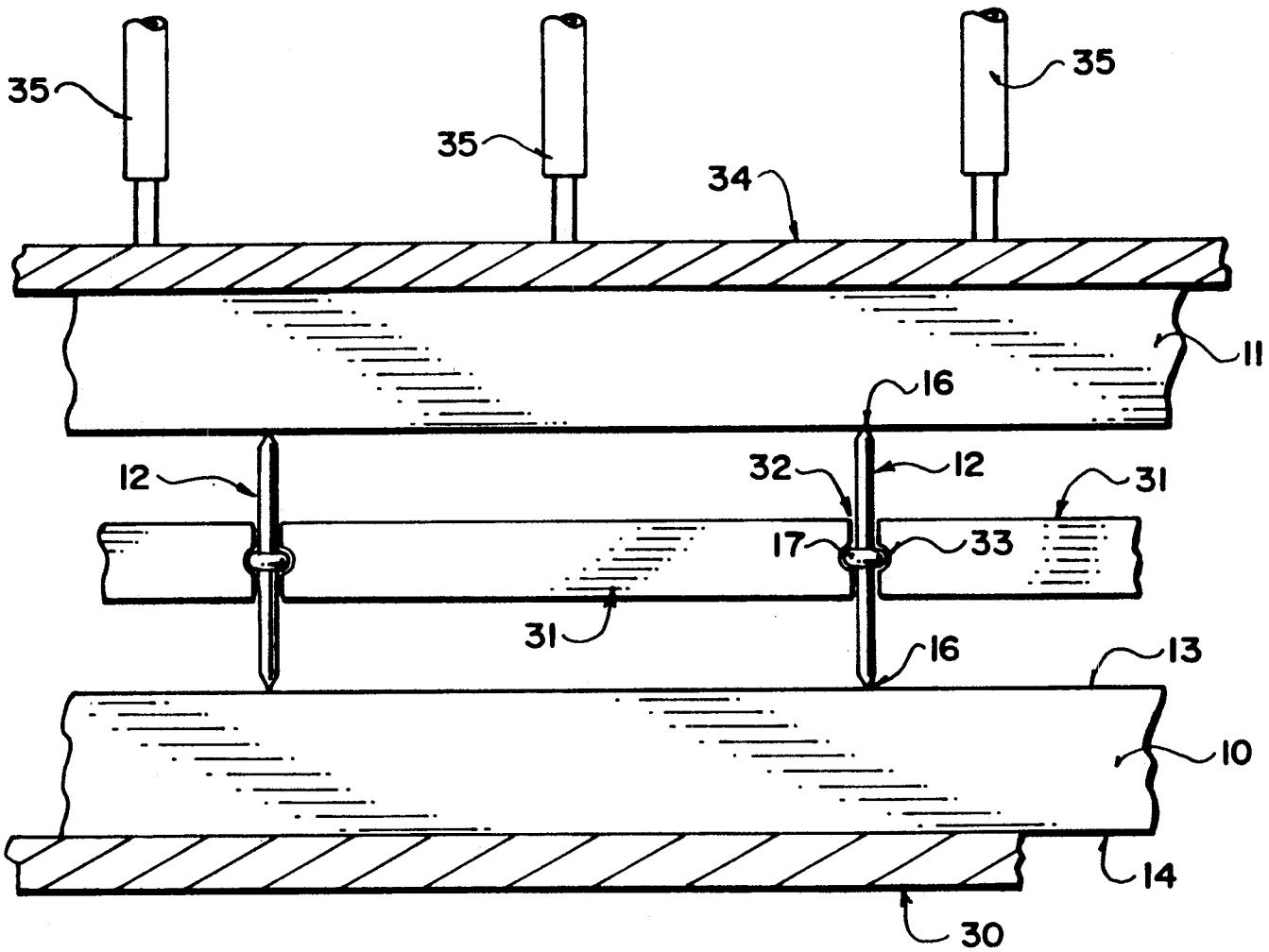
FIG. 4 is a schematic side elevational view of a method of forming the structural members according to the present invention.

In FIG. 4 is shown a method of formation of the structural member shown in FIG. 3. In this method the lower strip 10 is mounted upon or supported by a base plate 30 so that the edge 14 of the strip 10 lies horizontally on top of the base 30 with the surface 13 facing upwardly. A plurality of the pins 12 is mounted in a holding member 31 positioned above the base 30. The holding member 31 includes a plurality of slots 32 each for receiving a respective one of the pins. The slot includes a recess 33 into which the head 17 can project so that each pin is prevented from sliding vertically in the slot and is thus held at a particular vertical location by the holding member 31. The holding member 31 can then be moved forwardly or rearwardly to locate the lower pointed end 16 directly on top of the surface 13 and centrally located relative to the surface 13. The upper strip 11 is then located on top of the upper pointed ends 16 of the pins 12 and underneath a top plate 34. The upper and lower strips 11 and 10 can be clamped to prevent sideways movement by clamping elements (not shown).

In the method, the elements are assembled as shown in FIG. 4 and then the plate 34 is moved downwardly by hydraulic actuator schematically indicated at 35 so as to press the upper strip 11 downwardly toward the lower strip 10. The holding member 31 is also moved gradually downwardly so that the centre of the pins is maintained centrally between the strips 10 and 11 as the pointed ends of the pins are forced through the surfaces 13 into the interior of the strips 10 and 11. When the downward movement is complete, the structural member is then fully formed and the strips 10 and 11 are held at a fixed position in the space mutually parallel position shown in FIG. 3.

The structural member so formed can be simply cut to length in conventional manner by cutting through the separate strips 10 and 11. Generally this cutting will not occur at the location of a pin since the pins are relatively infrequent in comparison with the length of the strips. However if a cut should necessarily occur at a pin, the pin can simply be removed after carefully cutting each of the strips at the location of the pin.

In FIG. 1 services for the building are shown passing through the space between the strips 10 and 11 as indicated at 36. In addition insulating material is indicated at 37 filling the space between the strips and filling the space between one structural member and the next structural member in the wall construction. The material 37 is shown only partially installed but it will be apparent that in the completed construction the the insulated material fills the whole area.

In an alternative arrangement, the double pointed pins are replaced by pins which project through from the outside surface of one of the strips through the whole of that strip, through the space and into the interior of the other strip. The pin however stops short of the outside surface of the second strip. In a further alternative arrangement, the pins are of larger diameter and are inserted into predrilled holes. It is believed that the above construction will have some advantage in reducing the stress that otherwise occurs in solid lumber due to differences in thermal expansion caused by the temperature gradient from the exterior surface to the interior surface.

Figure 2:
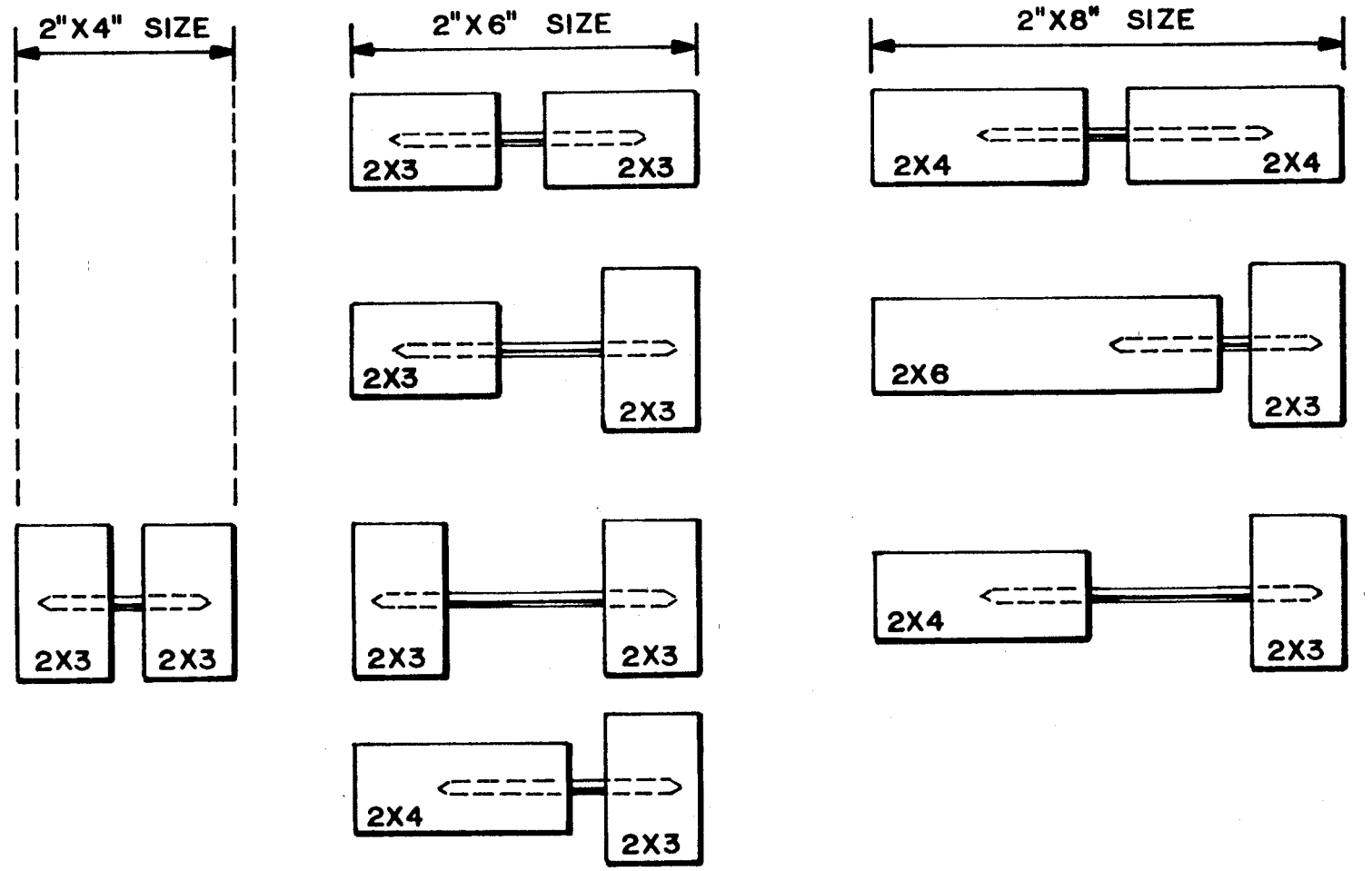
FIG. 2 is a chart showing a range of different sizes of structural members according to the present invention.

Referring now to FIG. 2, the specific layout and sizes of the strips and the completed structural member are shown for a number of examples. It will be noted that each of the strips is formed from a conventional lumber size for example 2×3 or 2×4 and the completed structural member is dimensioned the same as a conventional lumber size for example 2×6 or 2×8. This enables the structural members to be formed from existing strips which are readily commercially available and allows the strips to be formed into structural members which are usable with conventional structural materials.

The embodiment as set forth above therefore has the following advantages:

1) The structural member now defines a thermal break to reduce heat transfer across the inside and outside surfaces of the wall formed using the structural member.

2) The structural member acts as a sound break to reduce transmission of sound.

3) There is provided a passage for services automatically within the wall structure without necessity for cutting openings.

4) The structural member is of the same outside dimensions as regular structural members so that there is no modification necessary for the processes of use of the structural member.

5) There is less thermal stress across the structural member.

6) The structural member can be cut anywhere along its length without the necessity to cut through metal connecting members since even if a cut occurs at the transverse pin, the pin can simply be removed.

7) The pins forming the interconnections are provided wholly within the exterior bounds of the structural member so that there is no difficulty in stacking the structural members or sliding the structural members one against another.

8) Larger structural members can be provided without the necessity for single large pieces of wood thus enabling the structural members to be formed from less total material.

In an alternative arrangement (not shown) the pins are replaced by larger size structural members which may be of metal or wood or other suitable materials which are connected at right angles to the surfaces of the wooden strips and enter into the strips by predrilled holes. Such connection can provide an increased structural strength for example for use in roof trusses and ceiling joists.

Figure 5:
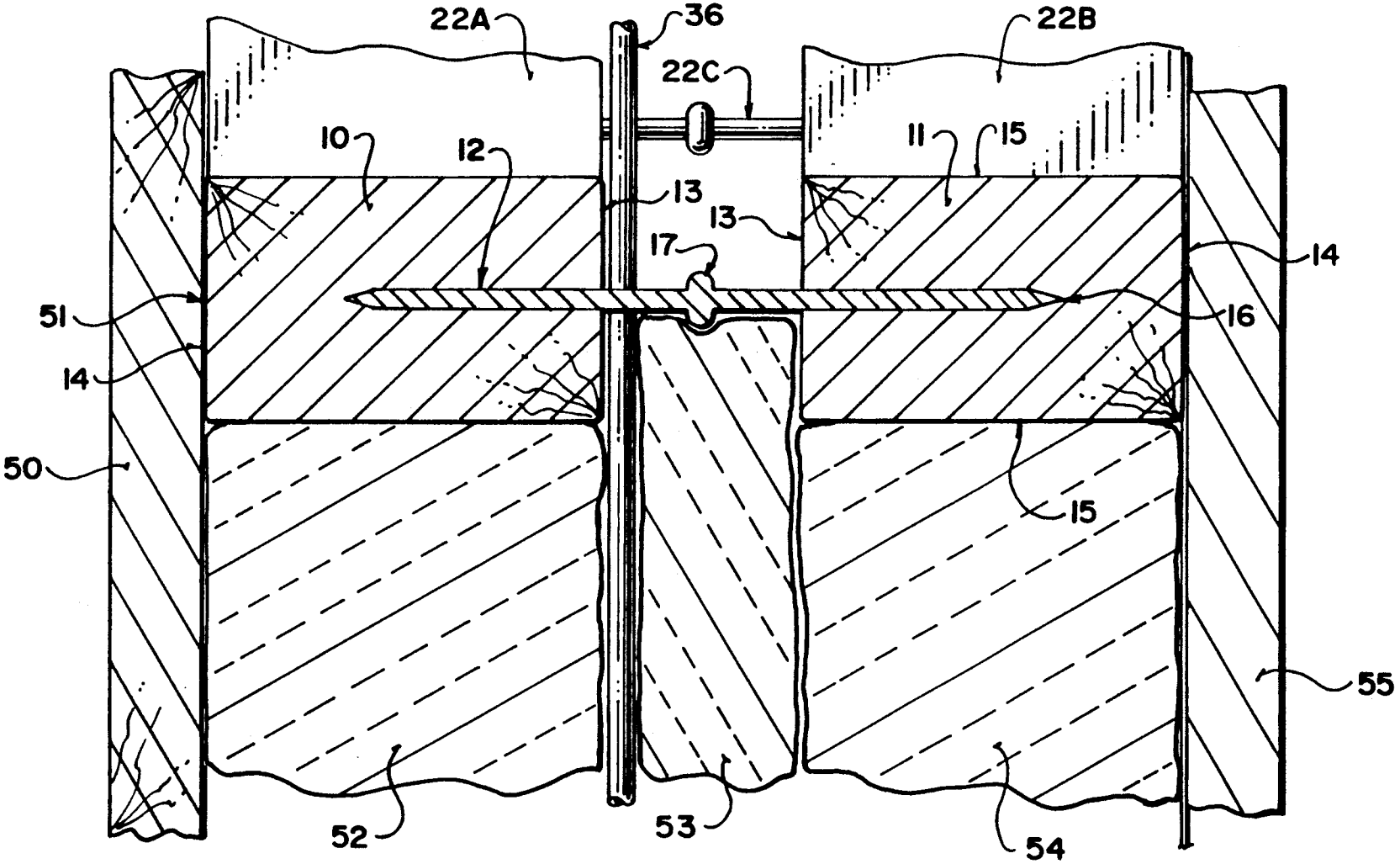
FIG. 5 is a horizontal cross-sectional view through one part of a wall of a building according to the present invention.

Turning now to FIG. 5 there is shown a horizontal cross section of the structural element of FIG. 3 assembled into a wall construction of the type shown in FIG. 1. Thus the structural element is mounted upon a base plate 22 including the elements 23A and 22B which extend along the full length of the wall and are connected by a plurality of pins one of which is visible at 22C. An outside sheathing 50 is applied to the wall construction when completed and is fastened in conventional manner to the outside surface 51 of the structural elements. The services for the building are passed through the cavity between the wooden members 10 and 11 of the structural elements with one such service element being indicated at 36. Insulation material is applied into the cavity between the structural elements and also between the wooden members 10 and 11 and this can be provided by various different types of insulation for example loose fill, foam or more preferably fiberglass batts. In the arrangement shown in FIG. 5, a first batt 52 is positioned between the element 10 and the element 10 of the next adjacent structural element so that the batt 52 has a width generally of the order of fourteen inches for conventional construction arrangements of sixteen inch centers. A second batt 53 is wider so that it reaches up to the midpoint of the wooden elements 10 and 11 adjacent the pin 12 and thus in a conventional arrangement would be sixteen inches in width. A third batt 54 is similar to the batt 52. The thickness of the batt is selected so the batts properly fill the spaces set forth above without voids and without overcompression. When the introduction of the services 36 is complete and the batts 53 and 54 are applied, an inner sheathing usually drywall indicated at 55 is applied on the inside surface of the wall.

In one preferred example, the thickness of the walls that is the outside dimensions of the elements 10 and 11 is of the order of ten to twelve inches. In such an arrangement the element 10 may be formed by a wooden element two inches by four inches and the element 11 may be formed by a wooden element two inches by three inches. The pins 12 can be of the order of 0.2 inches in diameter. Using such pins, the pins can be inserted into the wood simply by compression simply by clamping the pin at the center without a protuberance at the center. Since the pins are not intended to provide any structural strength or rigidity, the entry of the pins to different depths within the elements 10 and 11 is not of significant concern.

When planed, the wood ships both have a width transversely to the pins of the order of 1.5 inches and a thickness longitudinally to the pins selected to achieve a required wall thickness. One, probably the outer, strip has a thickness of at least 3.5 inches (nominally 4.0 inches).

The inner or spacer strip can have a thickness of at least 1.5 (nominally 2.0) inches. Generally the thickness of the spacer strip is less than that of the main outer strip. When attached by the pins, the side surfaces of the strips lie in parallel, common planes, spaced by the width of the strip.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of constructing a building comprising:

forming a plurality of structural members each comprising a first and a second elongate strip of wood which is generally rectangular in cross section arranged in spaced mutually parallel relationship so as to define first inwardly facing surfaces of the strips and second outwardly facing surfaces of the strips and a plurality of separate, straight, elongate connecting members extending from the first inwardly facing surface of the first strip to the first inwardly facing surface of the second strip so as to hold the strips in said relationship with said first surfaces of the first and second strips spaced apart to define a space therebetween, the connecting members being arranged at spaced positions longitudinally of the strips;

each of the structural members being assembled by the steps of locating the first strip and the second strip in spaced location with the first surfaces thereof facing inwardly, each connecting member including two pointed ends each for engagement with said first surface of the respective strip, holding the connecting members so as to remain at right angles to said first surfaces and forcing the pointed ends of the connecting members into each of the strips, such that each connecting member extends from one pointed end embedded with the interior of the first strip and spaced from the second surface thereof through said first surface thereof, across the space, through said first surface of the second strip and into the interior of the second strip with the pointed end embedded within the interior of the second strip and spaced from the second surface of the second strip;

subsequent to the assembly to the structural members, locating the structural members in vertical orientation and in horizontally spaced location to define a frame of a wall of the building such that the first strip of each structural member faces outwardly of the building and the second strip faces inwardly of the building and such that wall voids are defined between each structural member and the next;

using said space between the first and second strips which is free from intervening material for threading therethrough service lines for building utilities without cutting through the first and second strips;

applying sheathing material to the second surface of the first strips to form an outer sheathing for the building, applying sheathing material to the second surfaces of the second strips to form an inner sheathing for the building such that the connecting members are spaced from the inner and outer sheathing material to provide a thermal break; and filling the wall voids between each structural member and the next and the spaces between the first and second strips with an insulating material;

forming one of the first and second strips so as to have a width in a direction transverse to the length of the connecting members which is at least 1.5 inches and so as to have a thickness in a direction longitudinal of the length of the connecting members which is greater than said width;

and forming the other of the first and second strips so as to have a width in a direction transverse to the length of the connecting members which is substantially equal to the width of said one of the first and second strips; and so as to have a thickness in a direction longitudinal to the length of the connecting members which is less than the thickness of said one of the first and second strips.

2. The method according to claim 1 including forming said one of the first and second strips so as to have a thickness of at least 3.5 inches.

3. The method according to claim 1 including providing each connecting member in the form of a pin, engaging a portion of the pin with each said strip, each portion being provided such that it has a substantially cylindrical outer surface extending from said pointed end to and through the first surface of the strip and engaging the portion of the pin with the wood of the strip solely by frictional contact therewith caused by said forcing of the pointed end into the strip.

4. The method according to claim 3 wherein the connecting members are aligned in a single row.

5. A method of constructing a building comprising:

forming a plurality of structural members each comprising a first and a second elongate strip of wood which is generally rectangular in cross section arranged in spaced mutually parallel relationship so as to define first inwardly facing surfaces of the strips and second outwardly facing surfaces of the strips and a plurality of separate, straight, elongate connecting members extending from the first inwardly facing surface of the first strip to the first inwardly facing surface of the second strip so as to hold the strips in said relationship with said first surfaces of the first and second strips spaced apart to define a space therebetween, the connecting members being arranged at spaced positions longitudinally of the strips;

each of the structural members being assembled by the steps of locating the first strip and the second strip in spaced location with the first surfaces thereof facing inwardly, each connecting member including two pointed ends each for engagement with said first surface of the respective strip, holding the connecting members so as to remain at right angles to said first surfaces and forcing the pointed ends of the connecting members into each of the strips, such that each connecting member extends from one pointed end embedded within the interior of the first strip and spaced from the second surface thereof through said first surface thereof, across the space, through said first surface of the second strip and into the interior of the second strip with the pointed end embedded within the interior of the second strip and spaced from the second surface of the second strip;

subsequent to the assembly to the structural members, locating the structural members in vertical orientation and in horizontally spaced location to define a frame of a wall of the building such that the first strip of each structural member faces outwardly of the building and the second strip faces inwardly of the building and such that wall voids are defined between each structural member and the next;

using said space between the first and second strip which is free from intervening material for threading therethrough service lines for building utilities without cutting through the first and second strips;

applying sheathing material to the second surface of the first strips to form an outer sheathing for the building, applying sheathing material to the second surfaces of the second strips to form an inner sheathing for the building such that the connecting members are spaced from the inner and outer sheathing material to provide a thermal break;

filling the wall voids between each structural member and the next and the spaces between the first and second strips with an insulating material;

arranging the first and second strips such that side surfaces thereof lie in two parallel, common planes spaced by said width of said one of said first and second strips;

and forming the insulating material in three batts, including positioning a first batt inside the outer sheathing and between the first strip, positioning a second batt inside the first batt and between the connecting members, and positioning the third batt inside the second batt and between the second strips, the second batt having a horizontal dimension greater than that of the first and third batts such that side edges thereof abut the connecting members.

6. A method of constructing a building comprising:

forming a plurality of structural members each comprising a first and a second elongate strip of wood which is generally rectangular in cross section arranged in spaced mutually parallel relationship so as to define first inwardly facing surfaces of the strips and second outwardly facing surfaces of the strips and a plurality of separate, straight, elongate connecting members extending from the first inwardly facing surface of the first strip to the first inwardly facing surface of the second strip so as to hold the strips in said relationship with said first surfaces of the first and second strips spaced apart to define a space therebetween, the connecting members being arranged at spaced positions longitudinally of the strips;

each of the structural members being assembled by the steps of locating the first strip and the second strip in spaced location with the first surfaces thereof facing inwardly, each connecting member including two pointed ends each for engagement with said first surface of the respective strip, holding the connecting members so as to remain at right angles to said first surfaces and forcing the pointed ends of the connecting members into each of the strips, such that each connecting member extends from one pointed end embedded within the interior of the first strip and spaced from the second surface thereof through said first surface thereof, across the space, through said first surface of the second strip and into the interior of the second strip with the pointed end embedded within the interior of the second strip and spaced from the second surface of the second strip;

subsequent to the assembly to the structural members, locating the structural members in vertical orientation and in horizontally spaced location to define a frame of a wall of the building such that the first strip of each structural member faces outwardly of the building and the second strip faces inwardly of the building and such that wall voids are defined between each structural member and the next;

using said space between the first and second strips which is free from intervening material for threading therethrough service lines for building utilities without cutting through the first and second strips;

applying sheathing material to the second surface of the first strips to form an outer sheathing for the building, applying sheathing material to the second surfaces of the second strips to form an inner sheathing for the building such that the connecting members are spaced from the inner and outer sheathing material to provide a thermal break; and filling the wall voids between each structural member and the next and the spaces between the first and second strips with an insulating material; and, providing each connecting member in the form of a pin, engaging a portion of the pin with each said strip, each portion being provided such that it has a substantially cylindrical outer surface extending from said pointed end to and through the first surface of the strip and engaging the portion of the pin with the wood of the strip solely by frictional contact therewith caused by said forcing of the pointed end into the strip.

7. The method according to claim 6 wherein the connecting members are aligned in a single row.

8. The method according to claim 6 wherein the first and second strips are arranged such that side surfaces thereof lie in two parallel, common planes spaced by said width of said one of said first and second strips.

9. The method according to claim 8 wherein the insulating material is formed in three batts, a first batt being positioned inside the outer sheathing and between the first strips, a second batt being positioned inside the first batt and between the connecting members, and the third batt being positioned inside the second batt and between the second strips, the second batt having a horizontal dimension greater than that of the first and third batts such that side edges thereof abut the connecting members.

* * * * *